US005211462A

United States Patent [19]

Bien et al.

[11] Patent Number: 5,211,462

[45] Date of Patent: May 18, 1993

[54] DOUBLE DOOR REFRIGERATOR WITH ICE SERVICE THROUGH THE REFRIGERATOR DOOR

[75] Inventors: David L. Bien, Middleton; John J. Jaschinski, Cross Plains, both of Wis.

[73] Assignee: Sub-Zero Freezer Company, Inc., Madison, Wis.

[21] Appl. No.: 709,586

[22] Filed: Jun. 3, 1991

[51] Int. Cl.[5] ..... F25D 11/00

[52] U.S. Cl. ..... 312/404; 62/344; 312/407.1

[58] Field of Search ..... 312/401, 402, 404, 405, 312/407, 407.1, 237, 236, 292; 62/344, 266

[56] References Cited

U.S. PATENT DOCUMENTS 3,537,132 11/1970 Alvarez ..... 62/344

3,789,620 2/1974 Benasutti ..... 62/344

*Primary Examiner*—Kenneth J. Dorner
*Assistant Examiner*—Gerald A. Anderson
*Attorney, Agent, or Firm*—Foley & Lardner

[57] ABSTRACT

A refrigerator having a freezer compartment with a freezer door separated by a divider wall from a refrigerator compartment having a refrigerator door, an ice service area in the refrigerator compartment, an automatic ice dispenser within the freezer compartment for dispensing ice pieces, a passage in the divider wall for receiving the ice pieces from the dispenser and a chute assembly mounted on the divider wall in the refrigerator compartment for connecting the passage to the ice service area whereby ice pieces passing through the opening are directed to the service area by the chute assembly.

16 Claims, 4 Drawing Sheets

DOUBLE DOOR REFRIGERATOR WITH ICE SERVICE THROUGH THE REFRIGERATOR DOOR

FIELD OF THE INVENTION

The present invention relates to refrigerator having through the door ice service and more particularly to a double door type refrigerator having an ice cube dispenser in the freezer compartment and an ice service area in the door of the refrigerator compartment.

BACKGROUND OF THE INVENTION

Through the door ice service has traditionally been provided through the freezer door which requires opening of a passage through the freezer door into the freezer compartment, thus exposing the freezer compartment to room temperature and humidity whenever the dispenser is activated. As a result frost builds up in the freezer compartment which must be defrosted periodically to maintain freezer efficiency.

Typical examples of this type of ice service are shown in U.S. Pat. No. 4,102,660, entitled, "Ice Guide for Refrigerator with External Ice Service," issued on Jul. 25, 1978, wherein a trip mechanism is provided for opening and closing a door in the ice delivery chute. Water is also provided through a tube which extends through the door and door hinge to a reservoir in the refrigerator. U.S. Pat. No. 3,747,363 to Grimm and No. 4,306,757 to Horvay, et al. are typical examples of freezer door ice dispensers which dispense ice through a chute in the freezer door.

SUMMARY OF THE PRESENT INVENTION

The present invention is directed to an improved exterior ice and water service assembly for a double door refrigerator wherein ice cubes or pieces are formed in the freezer compartment and delivered from the freezer compartment to the refrigerator compartment for dispensing to an ice service area in the refrigerator compartment, thus eliminating any communication of the freezer compartment to room air and/or humidity.

The invention provides a means for delivering ice pieces from a freezer compartment to a service area in a refrigerator compartment by a simple chute assembly that assures delivery of the ice pieces to the ice service area.

The invention further contemplates the provision of a receptacle holder or recess in the refrigerator door which is positioned in the ice service area when the door is closed.

A simple door assembly is provided in the divider wall between the freezer compartment and the refrigerator compartment which is opened by the ice pieces and is self-closing thus eliminating the need for any mechanical or electrical door closing apparatus.

A further feature of the invention is the provision of a water dispensing system in the refrigerator which provides direct communication from the reservoir to the ice service area in the refrigerator door.

Another feature of the present invention is the elimination of frost on the delivery chute and door by providing a heating element in the door and mullion.

Other principal features and advantages of the invention will become apparent to those skilled in the art upon review of the following drawings, the detailed description and the appended claims.

Figure 1:
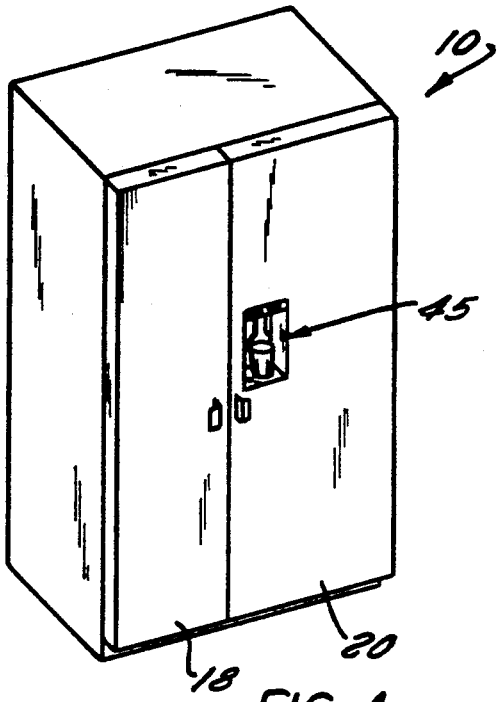
FIG. 1 is a perspective view of a double door refrigerator having an ice service area in the refrigerator compartment.
Figure 2:
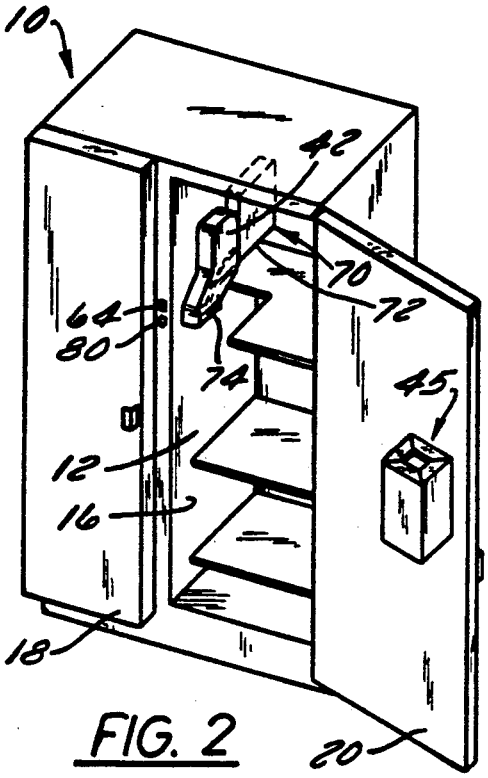
FIG. 2 is a perspective view of the refrigerator showing the ice chute assembly in the refrigerator compartment and the ice receptacle holder in the refrigerator door.
Figure 3:
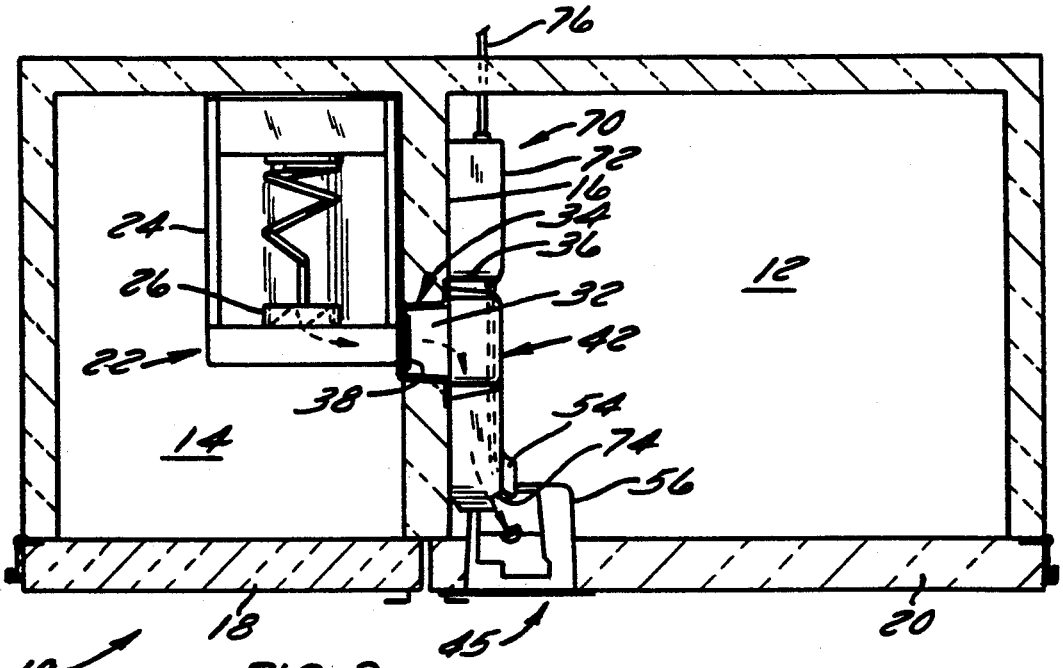
FIG. 3 is a top view in section of the refrigerator showing the ice dispenser, the chute assembly mounted on the divider wall, the water reservoir and the ice and water receptacle holder in the refrigerator door.
Figures 4, 5:
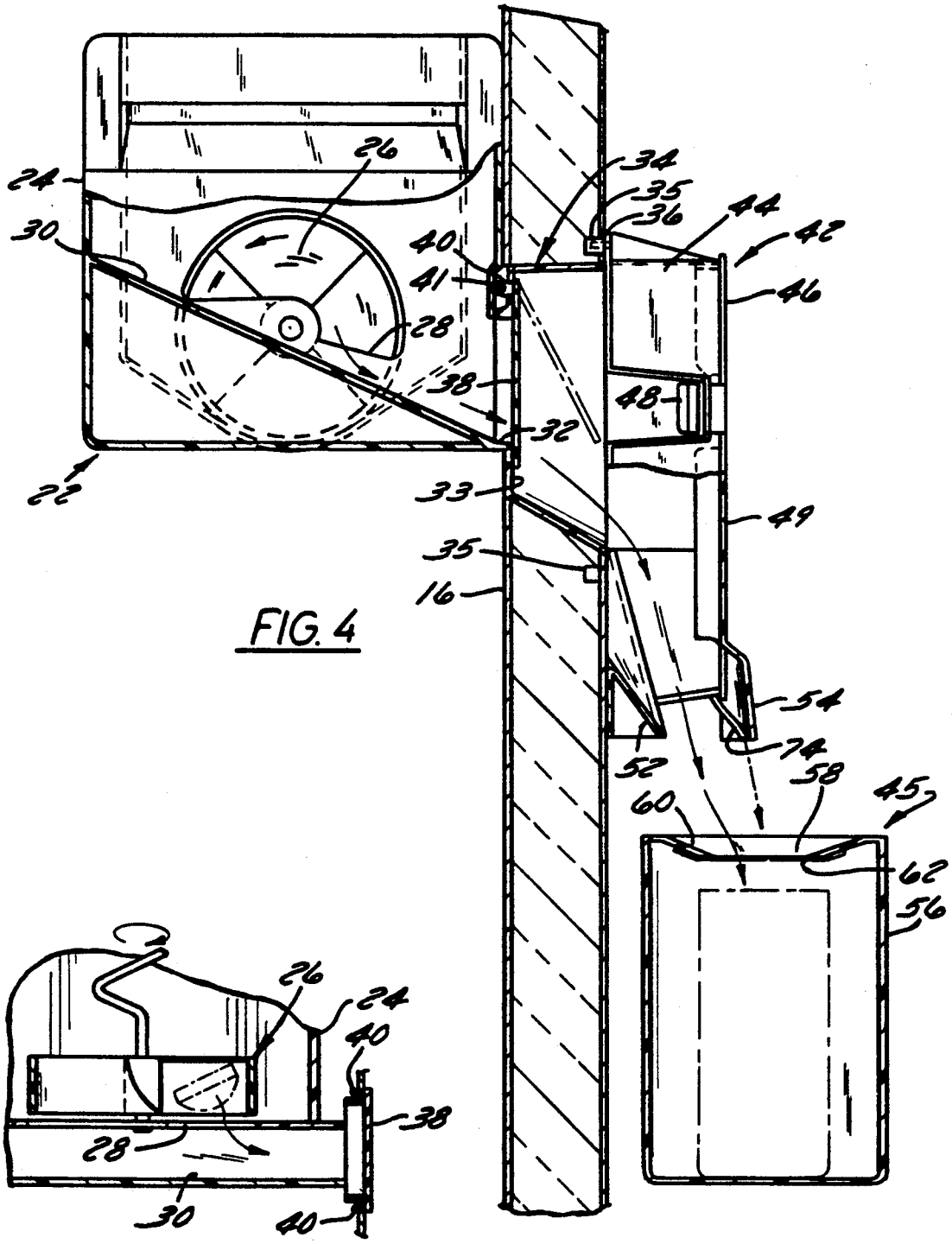
FIG. 4 is a partial sectional view of the divider wall showing the flow path of the ice pieces from the dispenser to the ice service area in the refrigerator.
FIG. 5 is a section view of a portion of the ice dispenser.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purposes of description and should not be regarded as limiting.

DETAILED DESCRIPTION OF A PREFERRED EMBODIMENT

In the embodiment of the invention shown in the drawings a refrigerator 10 is shown of the side-by-side type having a refrigerator compartment 12 and a freezer compartment 14 separated by a divider wall 16. The freezer compartment is accessed by a freezer door 18 and the refrigerator compartment is accessed by a refrigerator door 20.

A conventional ice piece maker (not shown) is provided in the freezer compartment for automatically forming ice pieces which are dispensed into an ice dispenser 22. The ice dispenser can be of a conventional design wherein ice is stored in a bucket 24 and dispensed from the bucket by a wheel 26. The ice pieces are dispensed from the bucket by the rotary motion of the wheel 26 through an opening 28 in the front of the bucket 24. The ice pieces discharged from the bucket are directed by a chute 30 toward the divider wall 16. The ice dispenser 22 can be actuated by a switch located at any convenient location on the refrigerator.

The divider wall 16 is provided with an opening 32 formed by a mullion chute 34 which is seated in the wall 16. The opening in the mullion chute 34 connects the freezer compartment 12 to the refrigerator compartment 14. The chute 30 must be aligned with the mullion chute 34 for directing the ice pieces into the refrigerator compartment 14. The mullion chute includes an inner frame 33 which defines the opening 32 and an outer frame 36 which is used to seat the mullion chute in the divider wall 16. The frame 36 is secured to the divider wall by plugs 35. A swinging door 38 is pivotally mounted in the mullion chute for closing the opening 32 to separate the freezer compartment 14 from the refrigerator compartment 12 thus eliminating any communication of the freezer compartment with room air and humidity.

Figure 6:
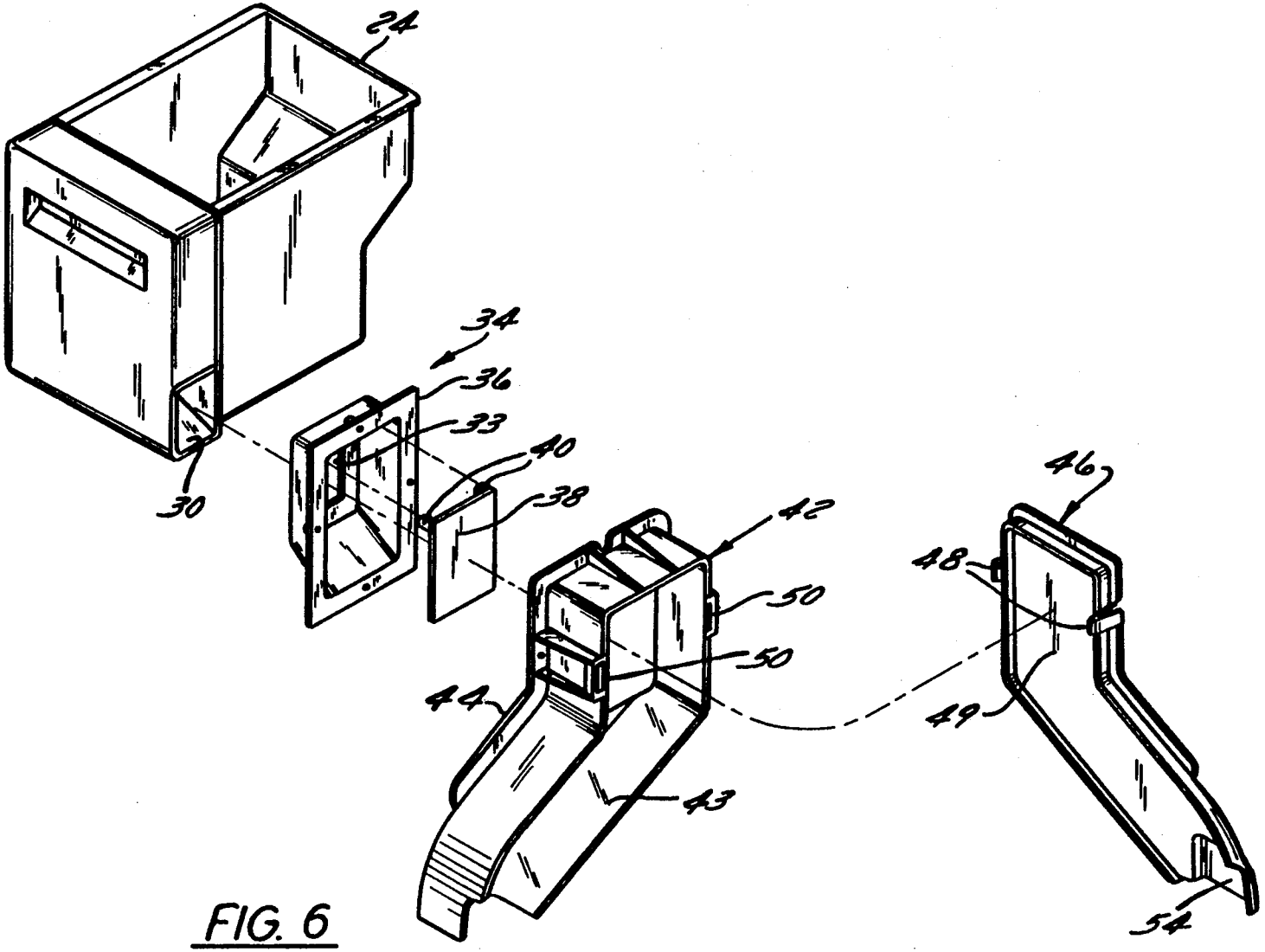
FIG. 6 is an exploded perspective view of the ice dispenser, the divider door mullion and the chute assembly.
Figure 7:
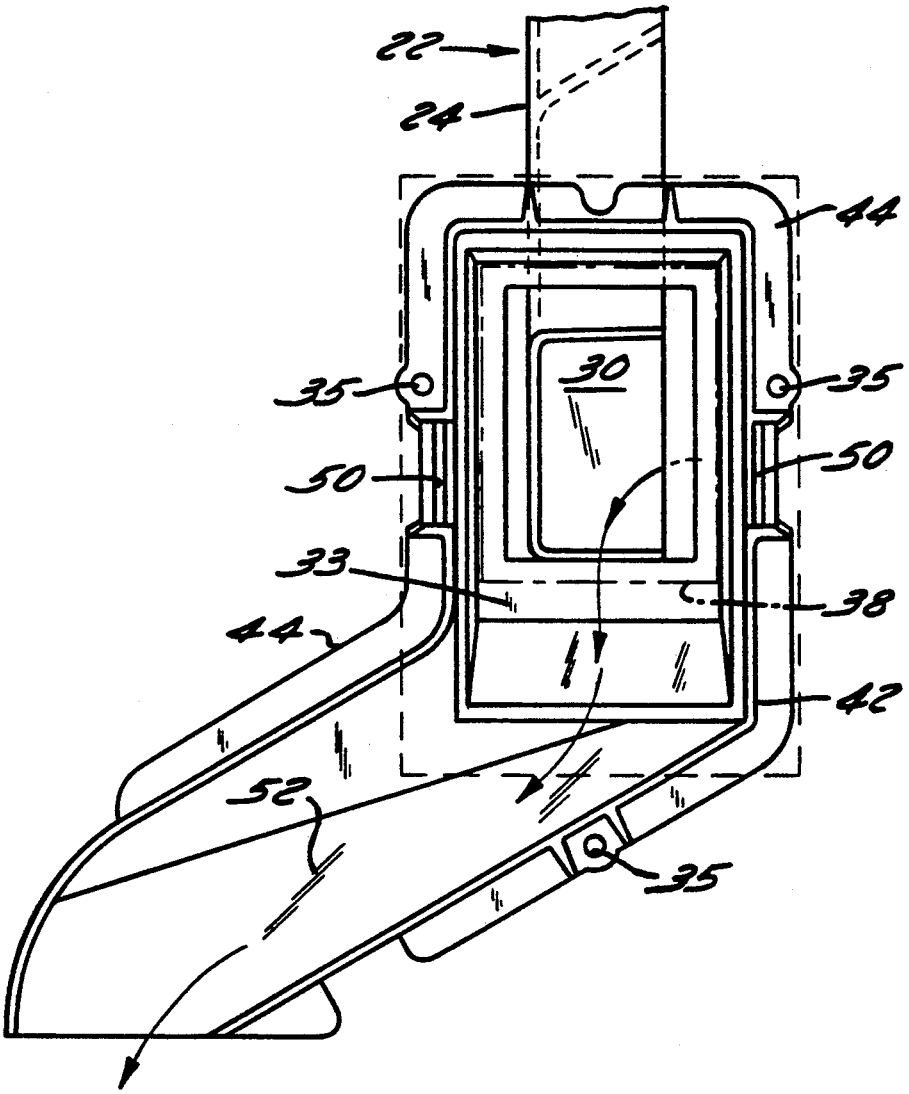
FIG. 7 is an elevation view of the chute assembly with the side wall cover removed.

In this regard it should be noted that the door 38, FIG. 6, includes a pair of tabs 40 at the upper end which are pivotally mounted on pins 41 provided on the mullion chute 34. The door 38 is free to pivot into the refrigerator compartment 12 when ice pieces sliding down the chute 30 impact the door. It should be noted that the hinge pins 41 are offset from the door to form a moment arm so that the weight of the door tends to pivot the door 38 into positive engagement with the inner frame 33. With this arrangement the freezer compartment is isolated from the refrigerator when not in use.

The mullion chute 34 may also be provided with means for heating the mullion chute 34 and door 38 to prevent the build up of ice in the chute 34 and door 38. Such means may be in the form of heater wires (not shown) wrapped around the outside of the mullion chute 34 and embedded in the door 38. The heater wires may be connected to any source of electricity provided in the refrigerator.

A discharge chute assembly 42 is mounted on the divider wall 16 in the refrigerator compartment 12 to direct the ice pieces to an ice service area 45 in the front of the refrigerator compartment. The chute assembly 42 includes a chute 43 for directing the ice pieces from the opening in the mullion toward the ice service area 45.

The chute assembly 42 includes a frame 44 for mounting the chute assembly on the divider wall 16 and a cover 46 for enclosing the chute 43. The cover 46 includes a wall 49 having a pair of tabs 48 on each side. The tabs 48 interlock with openings 50 provided on the chute assembly 42. It should be noted that the inside wall 52 of the chute assembly 42 is offset to direct the ice pieces into the service area 45 in a spaced relation to the wall 16. This allows room for placing an ice receptacle or bucket at the end of the chute for bulk ice service. The cover 46 is also provided with an offset portion 54 which deflects the ice pieces as they are discharged from the chute into the ice service area 45.

The refrigerator door 20 is provided with a receptacle holder 56 in the front of the door for holding a glass or the like. The holder 56 includes an opening 58 at the top which is aligned with the end of the chute assembly 42 when the refrigerator door is closed. Ice pieces can then be dispensed directly into the glass. A flexible seal 62 may be provided around the opening 58 to allow the ice cube pieces to fall through the opening 58 into the glass.

The refrigerator is also provided with means for dispensing bulk ice when the refrigerator door is open. Such means is in the form of a bulk ice service button 64 provided in the divider wall 16. The button 64 is electrically interconnected with the ice dispenser 22 to selectively activate the ice dispenser when the door is open.

A water dispenser system 70 is provided in the refrigerator section 12 which includes a reservoir 72 mounted on the divider wall 16 behind the chute assembly 43. Water is dispensed through a tube 74 which passes through the chute. The reservoir 72 is filled through a tube 76 in the back wall of the refrigerator section 12. Water can be dispensed directly into a glass in the door or directly from the chute in a receptacle at the end of chute 42. In this regard, a water service button 80 is provided in the divider wall 16 for bulk service conventional ice and water.

Thus, it should be apparent that there has been provided in accordance with the present invention a double door refrigerator with service through the refrigerator door that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A side-by-side double door refrigerator having a freezing compartment separated by a vertical divider wall from a refrigerator compartment, an ice dispenser in the freezer compartment, the ice dispenser including a chute for discharging ice pieces to one side of said dispenser, an opening in the divider wall in direct communication with said chute, a discharge chute assembly mounted on the vertical divider wall in the refrigerator compartment for directing ice pieces from the opening in the vertical divider wall to an ice service area in said refrigerator compartment.

2. The refrigerator according to claim 1 including a mullion chute in said opening in the divider wall for conducting ice pieces from said chute into said chute assembly.

3. The refrigerator according to claim 2 including a door pivotally mounted on said mullion chute for closing said opening to separate the refrigerator compartment from the freezer compartment.

4. The refrigerator according to claim 3 wherein said door is pivoted from the top of said mullion chute whereby said ice pieces will pivot the door to an open position to allow the ice pieces to pass through the opening.

5. The refrigerator according to claim 4 including means for heating said mullion chute and said door to prevent ice from forming in said mullion chute.

6. The refrigerator according to claim 1 including a receptacle holder in the refrigerator door, said holder being located in the ice service area when the door is closed.

7. The refrigerator according to claim 6 wherein said discharge chute is offset from said divider wall into alignment with said receptacle holder in said refrigerator door.

8. The refrigerator according to claim 7 including means in said refrigerator compartment for dispensing water through said discharge chute into said ice service area.

9. A side-by-side refrigerator having a freezer compartment with a freezer door separated by a vertical divider wall from a refrigerator compartment having a refrigerator door, and an ice service area in said refrigerator door, an automatic ice dispenser within the freezer compartment for dispensing ice pieces, a passage in the vertical divider wall in alignment with said dispenser for receiving the ice pieces from said dispenser, and a chute assembly mounted on the vertical divider wall in alignment with said dispenser in the refrigerator compartment connecting said passage to said ice service area whereby ice pieces passing through said passage are directed to said service area by said chute assembly.

10. The refrigerator according to claim 9 including means in the divider wall for closing said passage to isolate said freezer compartment from said refrigerator compartment.

11. The refrigerator according to claim 10 wherein said closing means comprises a mullion chute mounted in said divider wall to define said passage and a door suspended from the top of said mullion chute for pivotal movement from a closed position to an open position on engagement with ice pieces passing through said mullion chute into said chute assembly.

12. The refrigerator according to claim 11 wherein said refrigerator door includes a receptacle holder mounted on the refrigerator door in a position to receive ice pieces directed to said ice service area by said chute assembly when the refrigerator door is closed.

13. The refrigerator according to claim 11 including means for warming said mullion chute and said mullion chute door to prevent ice formation on said mullion chute and mullion chute door.

14. The refrigerator according to claim 9 including a water reservoir in said refrigerator and means for conducting water from said reservoir through said chute assembly to said ice service area.

15. A double door refrigerator having a freezing compartment separated by a divider wall from a refrigerator compartment, an ice dispenser in the freezer compartment, the ice dispenser including a chute for discharging ice pieces to one side of said dispenser, an opening in the divider wall in direct communication with said chute, a discharge chute assembly mounted on the divider wall in the refrigerator compartment for directing ice pieces from the opening in the divider wall to an ice service area in the front of said refrigerator compartment, a mullion chute in said opening in the divider wall for conducting ice pieces from said chute into said chute assembly, a door pivotally mounted on said mullion chute for closing said opening to separate the refrigerator compartment from the freezer compartment, wherein said door is pivoted from the top of said mullion chute whereby said ice pieces will pivot the door to an open position to allow the ice pieces to pass through the opening, and further including means for heating said mullion chute and said door to prevent ice from forming in said mullion chute.

16. A double door refrigerator having a freezing compartment separated by a divider wall from a refrigerator compartment, an ice dispenser in the freezer compartment, the ice dispenser including a chute for discharging ice pieces to one side of said dispenser, an opening in the divider wall in direct communication with said chute, a discharge chute assembly mounted on the divider wall in the refrigerator compartment for directing ice pieces from the opening in the divider wall to an ice service area in the front of said refrigerator compartment, including a receptacle holder in the refrigerator door, said holder being located in the ice service area when the door is closed, wherein said discharge chute is offset from said divider wall into alignment with said receptacle holder in said refrigerator door, and further including means in said refrigerator compartment for dispensing water through said discharge chute into said ice service area.

* * * * *